United States Patent [19]

Kasdagly et al.

[11] Patent Number: 4,575,166

[45] Date of Patent: Mar. 11, 1986

[54] CIRCUITRY ON MYLAR AND DUAL DUROMETER RUBBER MULTIPLE CONNECTOR

[75] Inventors: Dino G. Kasdagly, Rome, Pa.; Robert W. Little, Endicott, N.Y.

[73] Assignee: International Business Machines Corp., Armonk, N.Y.

[21] Appl. No.: 606,087

[22] Filed: May 1, 1984

[51] Int. Cl.[4] ..... H01R 23/72

[52] U.S. Cl. ..... 339/17 M; 339/61 M

[58] Field of Search ..... 339/17 F, 17 M, 17 LM, 339/59 M, 61 M

[56] References Cited

U.S. PATENT DOCUMENTS

| | | | |
|---|---|---|---|
| 3,629,787 | 12/1971 | Wilson | 339/17 F |
| 4,255,003 | 3/1981 | Berg | 339/17 M |
| 4,402,562 | 6/1983 | Sado | 339/61 M |

OTHER PUBLICATIONS

IBM Bulletin, Geil et al., vol. 13, No. 7, p. 1943, 12-1970.

Sid International Symposium Digest, Metal-Elastomer Connectors, pp. 64, 65, 5-1979.

*Primary Examiner*—Neil Abrams

*Attorney, Agent, or Firm*—Mark Levy

[57] ABSTRACT

Electrical connector for card-to-card coupling of dense semiconductor module circuitries on adjacent printed circuit cards or circuit boards. A pressure and connector element has a first high durometer layer for stiffness and a second low durometer layer for spring action. The low durometer layer is provided with deposited dense multiple connector elements. The connector elements are shaped to a radius or truss form, such that the applied fastening torque or clamping causes a truss displacement of the connector elements across the lands to be connected.

7 Claims, 11 Drawing Figures

CIRCUITRY ON MYLAR AND DUAL DUROMETER RUBBER MULTIPLE CONNECTOR

This patent application is related to concurrently filed patent application Ser. No. 606,086 for "Copper and Dual Durometer Rubber Multiple Connector" by D. G. Kasdagly and assigned to the present assignee.

BACKGROUND OF THE INVENTION

This invention relates to electrical connectors for coupling high-density electrical circuits and more particularly to a compressive connector element for establishing electrical connections between dense circuitries on adjacent printed circuit cards or circuit boards.

Nowadays, highly integrated semiconductor modules are mounted on cards which may be plugged into circuit boards. High-density connector leads are provided for coupling the modules to other devices on the same or on other boards. Separate entities of high computing and memory capacity are created by interconnecting cards or boards, each comprising at least one semiconductor module. Such interconnection of adjacent cards or circuit boards, comprising highly integrated semiconductor modules and associated dense connector leads, is even more critical than off-card connections where card circuitry can be connected to input/output cabling on a rigid frame.

Generally speaking, the requirements for card-to-card or board-to-board connectors, connecting semiconductor circuitries in adjacent modules, are the following:

(a) the distance covered by the contact should be as short as possible;

(b) positive mechanical retention of contact elements should be provided;

(c) the connector elements should be held in position under positive spring action; and (d) high rigidity and stiffness of the clamping member should provide for equal and uniform spring action.

U.S. Pat. No. 4,057,311 issued to Evans discloses an electrical board-to-board connector for coupling semiconductor module circuits on two spaced-apart cards. According to the teaching of this reference, two boards to be connected are mounted in different planes with edges overlapping. The connector body has multiple parallel connection elements sandwiched between the overlapping edges of the two adjacent boards. This approach requires connector leads to be placed on oppositely directed surfaces of the boards.

U.S. Pat. No, 3,597,660 issued to Jensen, et al discloses an off-card connector for coupling high-density edge conductors on module circuit boards with input-output circuit conductors of a cabling network. The overlays are formed on a flexible thin layer of polyimide material by printed circuit techniques and contact pressure is achieved through a resilient body under a pressure applying mechanism.

A major problem associated with connecting electrical circuits on separate circuit boards and providing an electrical connection therebetween, especially during the assembly process, is the potential for attracting dust or other contaminants to the connectors. It is important that the electrical connection be of high quality, due to the relatively small dimensions of the electrical lines. The integrity of the electrical connections is a function of the amount of extraneous material that adheres to the conductive elements. Accordingly, the copper surfaces to be connected should be as clean as possible prior to and during the assembly process.

It would be advantageous to provide a system for electrically and structurally connecting circuits on separate printed circuit boards.

It would further be advantageous for this system of circuit connections to be simply constructed with a minimum of moving parts and assembly complexity.

Moreover, it would be advantageous to provide a system for electrically connecting circuits on separate boards while ensuring the highest degree of cleanliness prior to and during the final assembly.

It would also be advantageous to provide an electrical bond between separate circuits on respective circuit boards having a means for positive mechanical retention so that the possibility of eventual disconnection is minimized or eliminated.

It would further be advantageous to provide a system for connecting a plurality of separate conductors on abutting circuit boards such that positive retention is assured equally for all of the connected conductors.

It would also be advantageous to provide preformed elements that are deformable under pressure to provide wiping and cleaning action of the copper surfaces immediately prior to completing the electrical connections.

SUMMARY OF THE INVENTION

It is the object of the invention to provide an improved connector between semiconductor module cards or boards. The connector should establish connections along the shortest possible distance, both in the wiring and in the connector itself. The connector should further provide positive mechanical retention and positive spring action. For uniform spring action at multiple connector contacts, high rigidity and stiffness are required.

A further object of the invention is to provide for a multiple card-to-card connector having a wiping action. More particularly it is a further object of the invention to provide for a truss displacement of the connector elements across the lands to be connected when applying a force upon mounting the connector body.

According to the present invention, multiple preformed connector elements are shaped to a radius, truss or similar form between the lands to be connected. When the resilient layer carrying the connector elements has a force applied thereto by a fastening or clamping means, truss displacement of the connector elements across the lands takes place, thus assuring a reliable contact under all circumstances. A layer of relatively high durometer material is attached to the other surface of the resilient layer to provide stiffness.

The foregoing and other objects, features and advantages of the invention will be apparent from the following more particular description of a preferred embodiment of the invention, as illustrated in the accompanying drawings.

DETAILED DESCRIPTION OF THE EMBODIMENTS

Figure 1:
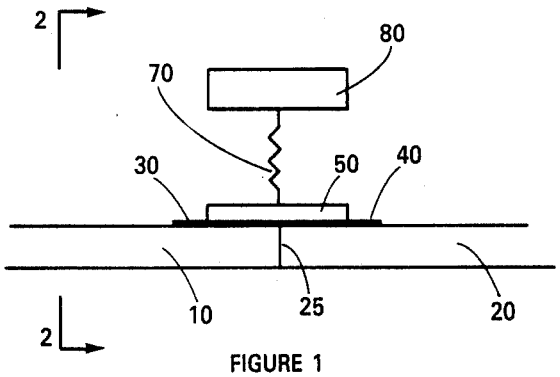
FIG. 1 is a schematic cross-sectional view of part of two abutting circuit boards and a multiple connector in accordance with the present invention across the edges thereof.

Referring now to FIG. 1, there is shown a first printed circuit board 10 on which is mounted one or more semiconductor modules and associated connecting circuits, not shown. The board 10 abuts a second printed circuit board 20 along common edges 25.

Disposed on printed circuit board 10 is a land 30, which terminates circuitry and is used to connect the semiconductor modules to outside devices. Circuit cards or boards carrying a highly integrated semiconductor module can have at least 50 lands per inch which are to be connected to corresponding lands on an abutting card or board. In spite of careful, automated manufacturing of the cards and attached lands to close tolerances, dimensional differences do occur and are compensated for by spring biasing as hereinbelow described. Corresponding to land 30 on printed circuit board 10 is another land 40 disposed on printed circuit board 20.

Extruded copper 50 is placed directly above the lands 30 and 40 and forms an electrical connection therebetween. It should be understood, however, that any electrically conductive material, such as platinum, aluminum and the like, can be used in place of copper 50. When oxidizable material such as copper is used, a plating process should be performed before connections are made. Gold or phosphor bronze plating of the copper lines 50 is preferred.

Surrounding the copper conductor 50 is a relatively resilient material 70 such as low durometer rubber. Any suitable polymer, such as polyvinyl chloride, thermoplastic elastomer (TPE) or the like with a durometer range of 60A-50D, can be used for this function. The resilient material 70 acts as a spring to urge the copper conductor 50 against the lands 30 and 40.

Bonded to the resilient material 70 is a more stiff, relatively high durometer rubber 80. Any high durometer material, such as styrene, acrylonitrile-butadiene-styrene (ABS), polypropylene or the like with a durometer range greater than 50D, may be used as the relatively stiff material 80, whose function it is to distribute a force transversely along the length of the common edge 25 of the boards 10 and 20.

Figure 2:
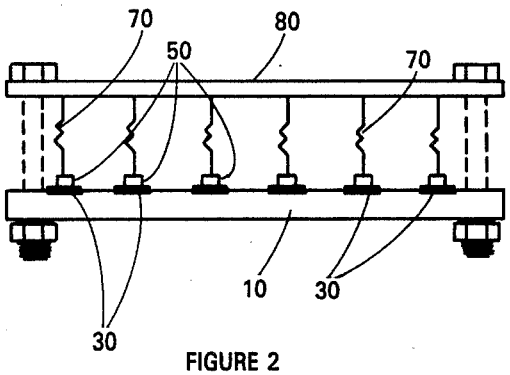
FIG. 2 is a side view of the multiple connector taken along line 2—2 of FIG. 1.

Referring now also to FIG. 2, there is shown a cross-sectional view taken along line 2—2 of FIG. 1. It can be seen that a plurality of lands 30 can be interconnected with corresponding adjacent lands, not shown in FIG. 2, and can be held in position by positive clamping action as hereinbelow further described. The multiple connector elements 50 formed of copper conductors are all spring loaded due to their relationship to the resilient material 70 in which they are embedded. The multiple connections between the multiple connector elements 50 and the lands 30 and 40 (FIG. 1) on cards 10 and 20 are made under positive spring pressure. When the relatively rigid, stiff member 80 bears down on the more resilient material 70, a substantially uniform pressure is urged against each individual connector element 50.

Figure 3A:
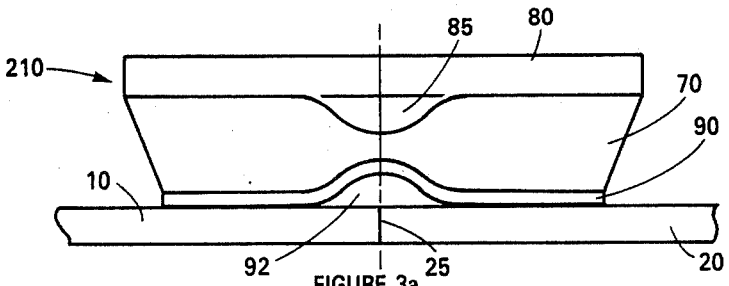
FIG. 3*a* is a cross-sectional view of the preferred embodiment of the multiple connector shown in its initial position.

Referring now also to FIG. 3*a*, there is shown a schematic illustration of the preferred embodiment of a connector body, shown generally as reference numeral 210, made of dual durometer rubber. The connector body 210 is shown in its initial position. A resilient portion or layer 70 provides spring action. Bonded to the resilient material 70 is a layer of more stiff material 80 to provide rigidity. The stiff material 80 has a protuberance 85 that is positioned in a corresponding upper surface depression formed in the resilient layer 70.

A layer of polyimide such as Mylar or other suitable material 90 is bonded to the lower surface of the resilient layer 70. The mylar 90 has embedded therein electrically connecting elements, not shown in FIG. 3*a*. The resilient layer 70 also has a lower surface depression 92 across its width over the common edges 25 between the abutting boards 10 and 20. Since the opposite surface of the resilient layer 70 facing the layer of high stiffness 80 contains a similar transverse depression 85, the resilient layer 70 is thinner between the lands to be connected.

Figure 3B:
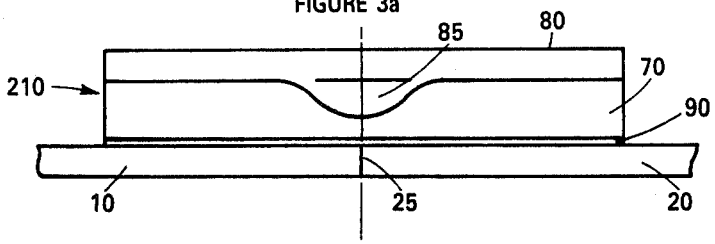
FIG. 3*b* is a cross-sectional view of the device shown in FIG. 3*a* in its final position.

Referring now also to FIG. 3*b*, the connector body 210 is shown in its final, compressed position. When a downward force is applied when mounting the connector, the lower depression 92 in the low durometer layer 70 is flattened by the protuberance 85 in the high durometer layer 80, pressing down the printed circuit connectors on the Mylar layer 90 against the lands 30 and 40 (FIG. 1) on the abutting cards 10 and 20, performing a wiping action.

Figure 4:
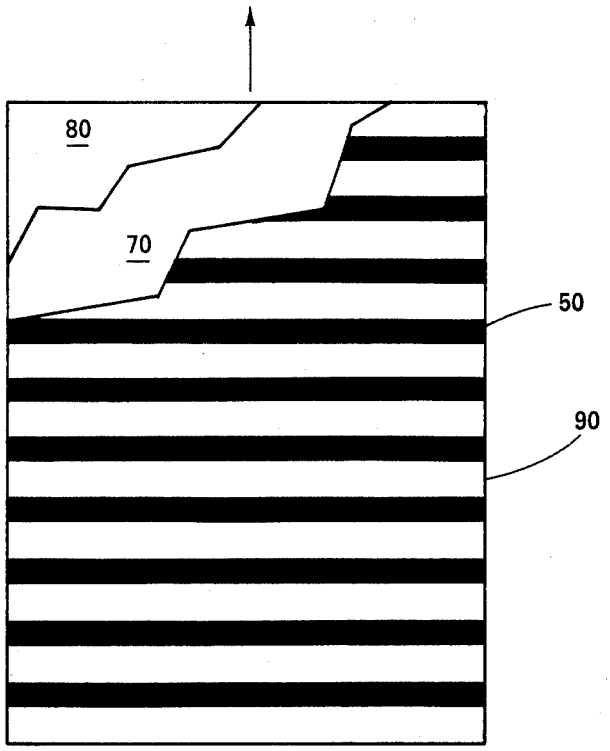
FIG. 4 is an exploded cut-away view of the connector element impregnated in Mylar polyimide (Mylar is a trademark of E. I. duPont Corp.)

Referring now also to FIG. 4, there is shown an exploded view of the Mylar layer 90 with spaced apart substantially parallel copper conductive lines 50 embedded therein. The resilient layer 70 and stiff layer 80 are shown partially covering the Mylar 90.

In FIG. 4, a vertical arrow indicates the direction in which the connector body 210 and Mylar with circuitry 50 are extruded. The extrusion process can be performed by any suitable means well known in the art. The extrusion die has a corresponding inverted V-shaped form. After this extrusion process is complete, circuitry on Mylar is bonded to the connector body 210 to form the connector.

In the course of extrusion, the relatively low durometer material 70 is bonded to the high durometer material 80 by heat in the preferred embodiment. It should be understood that any suitable means of bonding is acceptable and, in fact, the connection between the low durometer and the high durometer material need not even be permanent. The extruded part 210 can be produced in various lengths and cut to the required engagement length. Clearance holes, not shown, are drilled or stamped in the connector body for mounting to an understructure.

Figure 5:
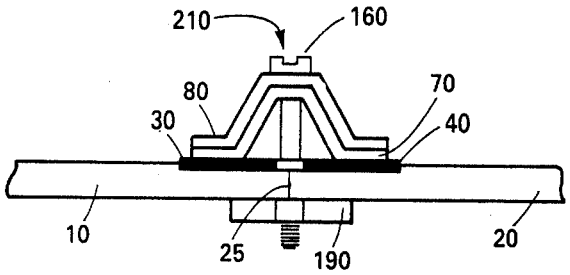
FIG. 5 is a cross-sectional view of an alternate embodiment of the multiple connector.

Referring now also to FIG. 5, there is shown an alternate embodiment of the card-to-card connector according to the invention. The card 10 is provided with a number of circuit terminating lands 30 which are connected to lands 40 on abutting card 20 through the multiple connector body 210. The connector body 210 consists of a first relatively high durometer rubber layer 80 and a second relatively low durometer rubber layer 70 having an inverted approximate V-shape configuration. The connector layers 80 and 70 are mounted on the edge surfaces of abutting cards 10 and 20 by fasteners 160 and support 190. The adjustable bolt or screw 160 is screwed into corresponding nut 190 to mount and clamp the connector body 210, previously cut to length, to the printed circuit boards 10 and 20. The copper lines 50 (not shown in FIG. 5) are thereby clamped between the connector body 210 and the printed circuit boards 10 and 20. It should be understood that while a nut and bolt are shown in FIG. 5 as the means for clamping the resilient rubber layer 70 to the printed circuit boards 10 and 20, thereby sandwiching the copper lines 50 and lands 30 and 40, any suitable positive clamping means can be employed, such as snap latches and the like. By applying a predetermined torque to the fastener 160, a truss displacement action results. Under pressure a wiping action takes place between the connecting element 210 and the corresponding lands 30 and 40 on the abutting cards 10 and 20. The copper connector leads 50 are forced against the lands 30 and 40 of the abutting cards or boards 10 and 20 with uniform pressure applied at each individual connection.

Thus the semiconductor module circuitry on card or board 10 is connected to the semiconductor module circuitry on card 20 through the connector device shown in detail in FIG. 4, providing multiple connections between the lands 30 on card 10 and corresponding lands 40 on card 20.

The high durometer layer 80 provides the required stiffness, while the low durometer layer 70 provides specified spring action and equal torque at each individual copper connector element 50.

Figure 6:
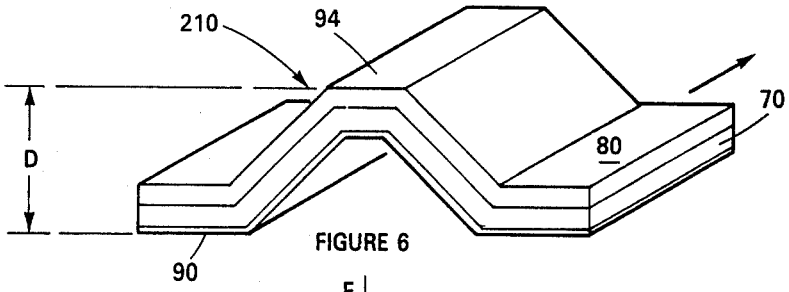
FIG. 6 is an isometric view of the connector body of FIG. 5.

Referring now also to FIG. 6, there is shown an exploded isometric view of the connector body 210 consisting of a three-layer V-shaped sandwich: high durometer layer 80 connected to low durometer layer 70 connected to Mylar layer 90, the Mylar layer 90 having electrically conductive elements (FIG. 4) embedded therein.

The distance D from the apex 94 to the Mylar layer 90 is approximately $\frac{1}{4}''$ to $\frac{3}{4}''$ in the preferred embodiment.

The arrow in FIG. 6 indicates the direction that the preformed connector body 210 is extruded during manufacture, corresponding to the direction shown in FIG. 4.

Figure 7:
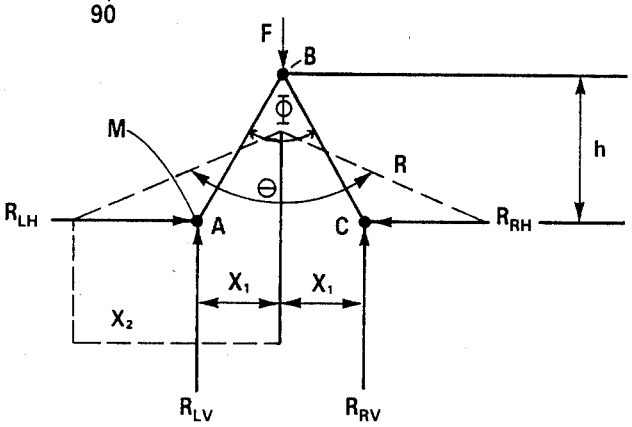
FIG. 7 is a free body representation of the connector of FIGS. 5 and 6.

FIG. 7 illustrates a free body diagram of the connector 210 and the fastener 160 and 190 (FIG. 5) subjected to a specific force F. Lines BA and BC correspond to the legs of the inverted V-shaped connector body. Letter h indicates the height of the connector. Variable $X_1$ represents one half the initial distance between the legs of the inverted V-shaped connector body 210 at the surface of the boards or cards 10 and 20. Upon mounting, the fastener 160 and 190 provides force F, resulting in the following equilibrium force analysis.

$$\Sigma FY=0 \rightarrow R_{LV}+R_{Rv}=F$$

$$\Sigma FX=0 \rightarrow R_{LH}=R_{RH}$$

The sum of the moments about point M is:

$$\Sigma MA=0 \rightarrow F(X_1)-R_{RV}(2X_1)=0$$

$$R_{RV}=R_{LV}=F/2$$

From FIG. 7 it is apparent that horizontal forces:

$$R_{LH}=R_{RH}=F \sin(\theta/2)$$

where $\theta$ represents the angle between legs of the connector body 210 in their final, compressed positions. As a result of applying force F to the connector body, displacement occurs and a wiping action Z takes place, according to this equation:

$$Z=X_2-X_1=R(\sin(\theta/2)-\sin(\Phi/2)$$

where $\Phi$ represents the angle between legs of the connector body 210 in their initial positions and $X_2$ represents one half the final distance between the legs of the inverted V-shaped connector body at the surface of the boards or cards.

This wiping action with force F applied through the resilient layer 70 to the individual connector elements 50 assures a reliable contact at each individual land 30 and 40 by means of the resulting positive spring action.

Figure 8A:
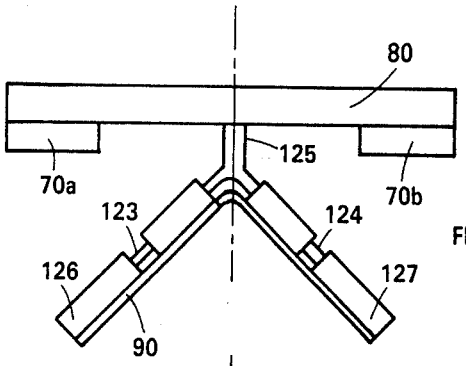
FIGS. 8*a*, 8*b* and 8*c* are cross-sectional views of another alternate embodiment of the multiple connector according to the present invention, shown in initial, intermediate and final positions, respectively.
Figure 8B:
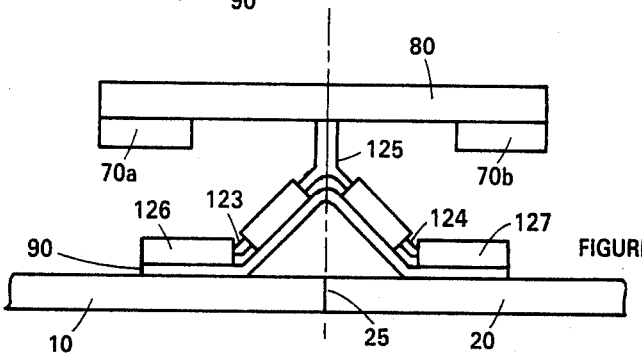
Figure 8C:
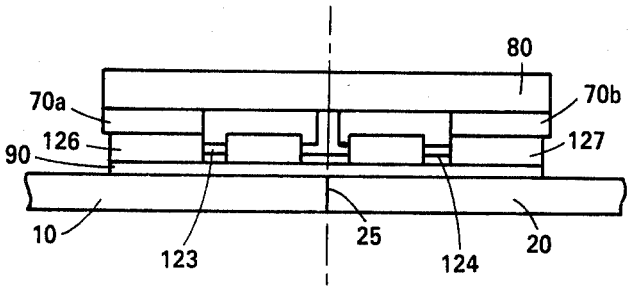

In FIGS. 8*a*–8*c*, another alternate embodiment of the card-to-card connector is shown. The high durometer rubber layer 80 for rigidity is provided with low durometer rubber layers 70*a* and 70*b* for spring action. The connector body of an inverted V-shaped configuration with legs 123 and 124 is supported by a central part 125. The legs 123 and 124 are provided with high durometer rubber parts 126 and 127 for rigidity, provided with Mylar 90 or a layer of a similar material, carrying the printed connector circuitry (FIG. 4). The connector body is again fabricated by an extrusion process, extrusion being carried out a direction perpendicular to the plane of the drawing.

FIGS. 8*b* and 8*c* show different stages of the connector device when being mounted with pressure applied to the high durometer rubber layer 80. FIG. 8*b* shows an intermediate stage, in which the lower parts of the legs 123 and 124 of the connector are wiped across the lands 30 and 40 (FIG. 1) on the upper surfaces of the abutting cards 10 and 20.

FIG. 8*c* shows the final stage. With pressure applied to the stiff layer 80, both legs 123 and 124 of the inverted V-shaped connector body are pressed bodily against the lands 30 and 40 on the upper surfaces of the cards 10 and 20, resulting in a wiping action. In this final stage, the resilient layers 70*a* and 70*b* contact the stiff layers 126 and 127, respectively, thus providing a positive spring action at each individual contact between each printed circuit connector element and associated lands on the abutting cards, which spring action is applied after the wiping action has taken place.

From the foregoing description, it can be seen that connecting two separate lands on two separate printed circuit boards or cards respectively has been shown. This manner of connecting provides the shortest possible distance between the contact lands. Moreover, the manufacture of this connector is relatively inexpensive and space requirements are low.

While the preferred and alternate embodiments of the invention have been illustrated and described, it is to be understood that there is no intention to limit the invention to the precise constructions herein disclosed and the right is reserved to all changes and modifications coming within the scope of the invention as defined in the appended claims.

What is claimed is:

1. An electrical connector for multiple connection of closely spaced juxtapositioned lands on a first circuit board to corresponding lands on a second circuit board abutting said first circuit board, said connector comprising: a connector body having a first layer of relatively high stiffness and a downwardly disposed protuberence formed therein, a second relatively resilient layer having a relatively thin portion disposed intermediate thicker, displaceable portions of said resilient layer, said relatively thin portion being formed by top and bottom transverse depressions and being operatively connected to said first layer, said top transverse depression being adapted to receive said protuberence, and multiple preformed electrically conductive connector elements operatively connected to said relatively resilient layer and partially embedded therein, said connector body being adapted to be mounted on the upper edge surfaces of said first and second circuit boards for establishing spring loaded multiple connections so that, in the process of outwardly displacing said thicker portions of said relatively resilient layer, each one of said preformed electrically conductive connector elements wipes across each pair of corresponding lands when said elements are pressed against said lands on said first and second circuit boards.

2. The electrical connector according to claim 1, wherein said second resilient layer has multiple electrically conductive printed circuit connector elements extending across said bottom depression.

3. The electrical connector according to claim 2 wherein said first and second layers are comprised of rubber.

4. An electrical connector for connecting a first set of juxtapositioned electrical terminals disposed on a first circuit board to a second set of juxtapositioned electrical terminals disposed on a second circuit board, said second circuit board abutting said first circuit board and being substantially coplanar therewith, comprising:

(a) A layer of relatively high durometer rubber having formed therein a downwardly disposed protuberance;

(b) A layer of relatively low durometer rubber with an upper surface operatively connected to said relatively high durometer rubber layer, said layer of relatively low durometer rubber having a relatively thin portion for facilitating displacement thereof, said relatively thin portion being intermediate thicker, displaceable portions of said low durometer rubber layer, and being oppositely disposed to, and adapted to receive, said protuberance when a substantially vertical force is applied thereto; and (c) multiple preformed electrically conductive elements comprising Mylar and conductive circuitry operatively connected to the lower surface of said relatively low durometer rubber layer and proximate each of said sets of electrical terminals, said electrically conductive connector elements being deformable and forming a gap with said circuit boards in an initial position, said gap being substantially eliminated in a final position, as said layer of relatively low durometer rubber is displaced and said elements are forced to wipe against said electrical terminals, to form electrical connections between electrical terminals on said first circuit board and electrical terminals on said second circuit board.

5. The electrical connector in accordance with claim 4 wherein said multiple electrically conductive connector elements brush across said sets of electrical terminals during said formation of electrical connections therebetween.

6. The electrical connector in accordance with claim 4 wherein said multiple preformed electrically conductive connector elements are substantially parallel to one another.

7. The electrical connector in accordance with claim 4 wherein said electrical terminals are wiped by said multiple preformed electrically conductive connector elements during deformation thereof.

* * * * *